US007408472B2

(12) United States Patent
Von Gunten

(10) Patent No.: US 7,408,472 B2
(45) Date of Patent: Aug. 5, 2008

(54) DEVICE FOR SIMULATING HUMAN ACTIVITY IN AN UNOCCUPIED DWELLING

(76) Inventor: Lee Von Gunten, P.O. Box 974, West Jordan, UT (US) 84084

( * ) Notice: Subject to any disclaimer, the term of this patent is extended or adjusted under 35 U.S.C. 154(b) by 0 days.

(21) Appl. No.: 11/379,113

(22) Filed: Apr. 18, 2006

(65) Prior Publication Data

US 2006/0186740 A1 Aug. 24, 2006

Related U.S. Application Data

(63) Continuation-in-part of application No. 10/906,489, filed on Feb. 22, 2005.

(51) Int. Cl.
*G08B 17/00* (2006.01)

(52) U.S. Cl. ..... 340/584; 340/588; 340/656; 200/19.01; 200/43.02; 307/132 T; 374/102

(58) Field of Classification Search ..... 340/584, 340/588, 309.9, 309.16, 309.3, 309.4, 655, 340/656; 368/10, 107; 374/100, 102, 113; 307/112, 113, 157, 132 T; 200/19.01, 43.02
See application file for complete search history.

(56) References Cited

U.S. PATENT DOCUMENTS

| | | | | | |
|---|---|---|---|---|---|
| 3,584,222 | A * | 6/1971 | Nesbitt | 250/206 |
| 3,727,063 | A * | 4/1973 | Turner | 250/206 |
| 4,060,123 | A * | 11/1977 | Hoffman et al. | 165/11.1 |
| 4,323,762 | A * | 4/1982 | Ervin et al. | 219/482 |
| 4,367,416 | A * | 1/1983 | Von Gunten | 307/132 R |
| 5,258,656 | A * | 11/1993 | Pawlick | 307/141 |
| 5,357,170 | A * | 10/1994 | Luchaco et al. | 315/159 |
| 6,167,000 | A * | 12/2000 | Chow | 368/10 |
| 6,307,812 | B1 * | 10/2001 | Gzybowski et al. | 368/10 |
| 6,356,425 | B1 * | 3/2002 | Jung | 361/93.8 |
| 6,903,284 | B2 * | 6/2005 | Dunfield et al. | 200/51 R |

* cited by examiner

*Primary Examiner*—Davetta W. Goins
(74) *Attorney, Agent, or Firm*—Geoffrey E. Dobbin

(57) ABSTRACT

The present invention is a thermally activated electrical switch for use in simulating human activity. The invention is features dual heat sources enclosed in a thermally isolated chamber within the invention. Since the activation of the switch is dependent upon the ambient temperature of the environment, it opens and closes at sufficiently random intervals to simulate human activity. This embodiment includes the use of a photoelectric sensor to further vary timing of the switch actuation.

10 Claims, 4 Drawing Sheets

DEVICE FOR SIMULATING HUMAN ACTIVITY IN AN UNOCCUPIED DWELLING

CROSS-REFERENCE TO RELATED APPLICATIONS AND PATENTS

This Application claims priority as a CIP application based on prior Non-Provisional Application No. 10/906,489, filed Feb. 22, 2005, which is incorporated by reference.

FIELD OF THE INVENTION

The present invention relates to the field of electrical security timers and more particularly relates to a randomized timer that is thermally and luminescently operated.

BACKGROUND OF THE INVENTION

Over the past 40 years, consumers, for the purpose of home security, have purchased millions of automatic switches, manufactured by several major manufacturers, for the purpose of simulating human activity in dwellings and other buildings to deter burglars when the occupants of the dwelling or building are away. Typical switches are clock operated. All of these clock-operated switches are settable to turn the light on or off, either on the hour or the half hour, two or more times in a 24-hour period. This practice of using a timer has become so widespread that it has become common knowledge that if the lights in a house switch on or off on the hour or the half hour, or at the same time on successive nights, that this is an indication that the owners are away and the house is unoccupied, indicating that a timer is being used to simulate occupancy. Even the popular movie of the late 1990's, entitled "Home Alone" has as a theme, the burglars who checked the time that the lights came on to determine that the owners were away on vacation.

The predictability of the timing of these devices has rendered them virtually counter-productive as burglar deterrents, as they now serve as much to inform the burglars of the absence of the occupants. In addition to the electromechanical clock types described, solid-state equivalent units are also available, also having the same inadequacies as the electromechanical types, for the purpose intended.

Notwithstanding their obsolescence as effective burglar deterrents due to their well known predictability, still they are continuously sold in all department stores, hardware stores, chain stores, discount stores and variety stores throughout North America, because no preferred alternative has been made available. It is the purpose of this invention therefore, to make available such alternative to better fill the need.

All clock operated timers and also the solid-state equivalent types, have three functional inadequacies which prevent them from being effective burglar deterrents. First, they are precisely predictable, because they operate at the same times, day after day. Second, they are vulnerable to power interruptions, which gets them "off-schedule" until manually reset by the owner, who may be away for days or weeks, or in the case of a vacation home, they can be off-schedule for months. Third, the setting of time of day, and programming the turning on and off of the lights is time consuming, complicated, and bothersome.

The present invention overcomes all 3 of the above inadequacies, as will be explained herein below. The present invention described herein controls the lights in a way that is completely unrelated to horological time. The present invention will never, or very rarely if ever, turn its load on or off at the same time as the previous day. The present invention is so unlikely to turn its load on or off at the same time as the previous day, that it is estimated by probability at one chance in approximately 500,000.

Second, because the present invention has no relationship to the horological clock, and has no horological schedule. Therefore, after a power interruption, and when the power is restored, the present invention continues turning its load on and off at intervals unrelated to horological timing, and therefore continues to serve the intended purpose just as effectively as if the power interruption had not occurred. Third, the present invention eliminates the need for any setting of time of day and time-of-operation programming. In contrast, a single switch, set to "security" position in an instant, is all that is needed to enable the invention to function for its intended purpose.

The invention herein described is designed to be useful in three different embodiments as herein below described. In its basic simplest form, the user simply turns this invention on or off by a single manual switch. The invention may also be combined with a day/night photoelectric sensor, which is well known in the art. In this embodiment the invention functions during the night, but not during the day. The invention may also be combined with a clock-operated switch, well known in the art, so as to function within selected hours only. In all three of the above embodiments the invention can be configured to plug directly into the wall outlet of the home, or fitted with a power cord and plug, and placed on any convenient table. It is available, therefore, as either "wall models" or "table models" for the convenience and preference of the user.

While it is recognized, that the switching on and off of lamps and other electrical loads by electromechanical or electro-thermal means, as well as the timing of such switching, can be duplicated by solid state electronic means, using integrated circuits, triacs and other solid-state components, it should be noted that the use of solid state means, such as triacs, alters and distorts the waveform of the electrical current. This distortion is unsafe for any complex electrical device except an incandescent lamp. The present invention, as disclosed without solid state circuitry (though such circuitry may be used in controlling the actual switches and loads inside the device), does not distort the electrical waveform and is therefore safe for use with any electrical load, including consumer electronics and non-incandescent lamps.

SUMMARY OF THE INVENTION

In view of the foregoing disadvantages inherent in the known types of security switches this invention provides an improved thermally activated security switch. As such, the present invention's general purpose is to provide a new and improved security switch that will operate independently from horological time.

The present invention is a thermally activated device for the simulation of human activity in an unoccupied dwelling. In its most basic embodiment, the invention utilizes a thermally sensitive switch, which when in use is electrically connected to a standard household electrical receptacle. Two heat sources are adjacent the switch, a primary resistor set and a secondary resistor. Both are connected to the electrical source in a parallel relation to the switch, but the primary, and significantly larger, resistor set is guarded by a triac gate in combination with a photo sensitive resistor, so that the gate is activated only when the resistor is not exposed to light and operating at a high resistance. All of the resistors and the switch are housed in a thermally insulating switch housing, which is in turn housed within an exterior housing. Exterior housing may feature an electrical receptacle and a primary bypass switch, allowing a user to bypass the thermal switch and maintain a continuous electrical current between the interface and receptacle.

In use, the device is plugged into a receptacle and a load, such as a lamp or television set, is plugged into the device's receptacle. For everyday use, the primary switch is left in a continuous "on" position, electrically bypassing the thermal switch. For security use, the primary switch directs current to the thermal switch and photocell and triac gate combination. Usually, the thermal switch is open, but as the resistors raise the surrounding temperature in the thermally insulated housing, the thermal switch is closed. The surrounding temperature drops slowly as secondary resistor is still providing heat and the thermally insulated housing slows heat transfer away from the switch. Eventually, the temperature cools to the point that the thermal switch again opens and allows current through.

The more important features of the invention have thus been outlined in order that the more detailed description that follows may be better understood and in order that the present contribution to the art may better be appreciated. Additional features of the invention will be described hereinafter and will form the subject matter of the claims that follow.

Many objects of this invention will appear from the following description and appended claims, reference being made to the accompanying drawings forming a part of this specification wherein like reference characters designate corresponding parts in the several views.

Before explaining at least one embodiment of the invention in detail, it is to be understood that the invention is not limited in its application to the details of construction and the arrangements of the components set forth in the following description or illustrated in the drawings. The invention is capable of other embodiments and of being practiced and carried out in various ways. Also it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION OF THE PREFERRED EMBODIMENT

Figure 1:
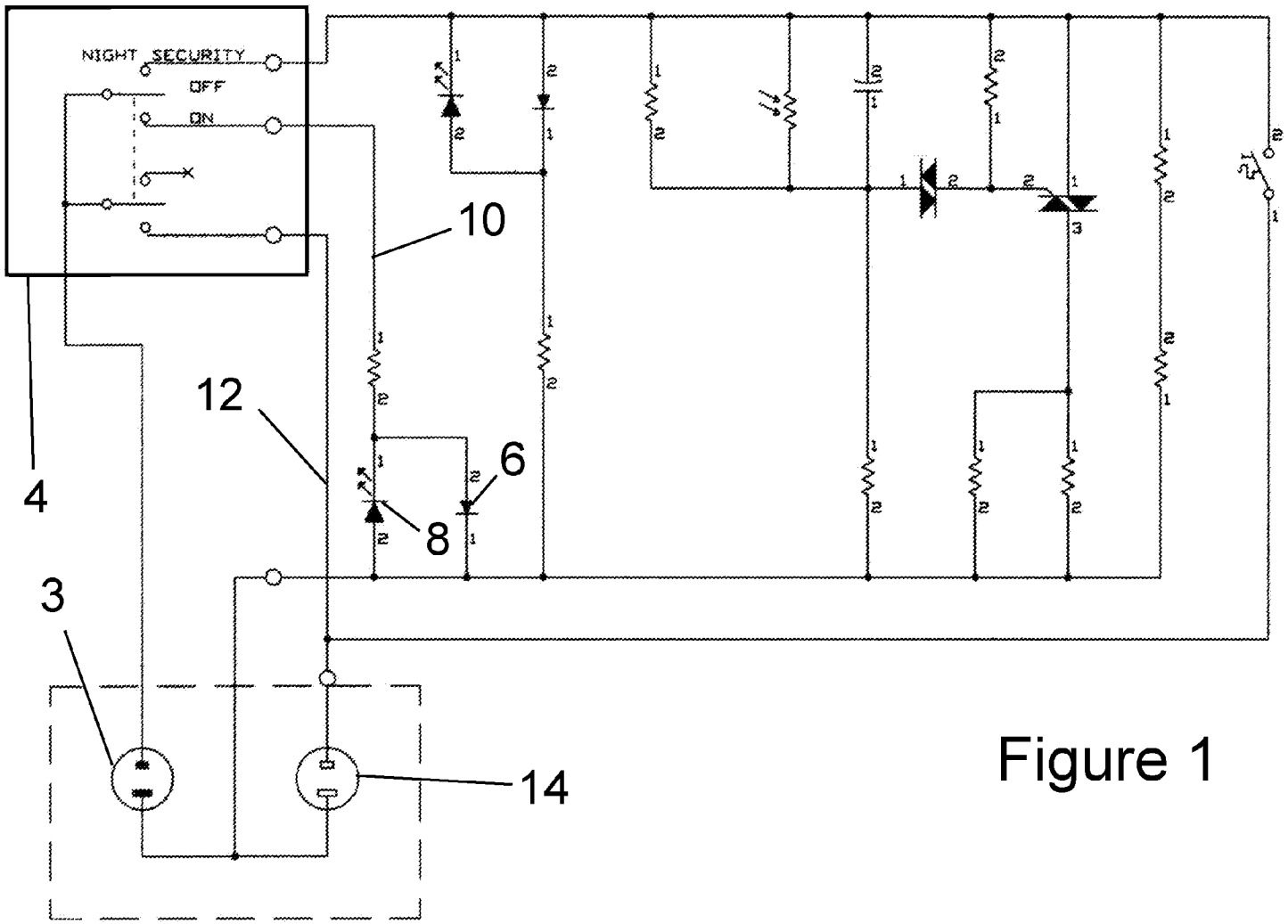
FIG. 1 is a circuit diagram of the present invention in open (off) mode.
Figure 2:
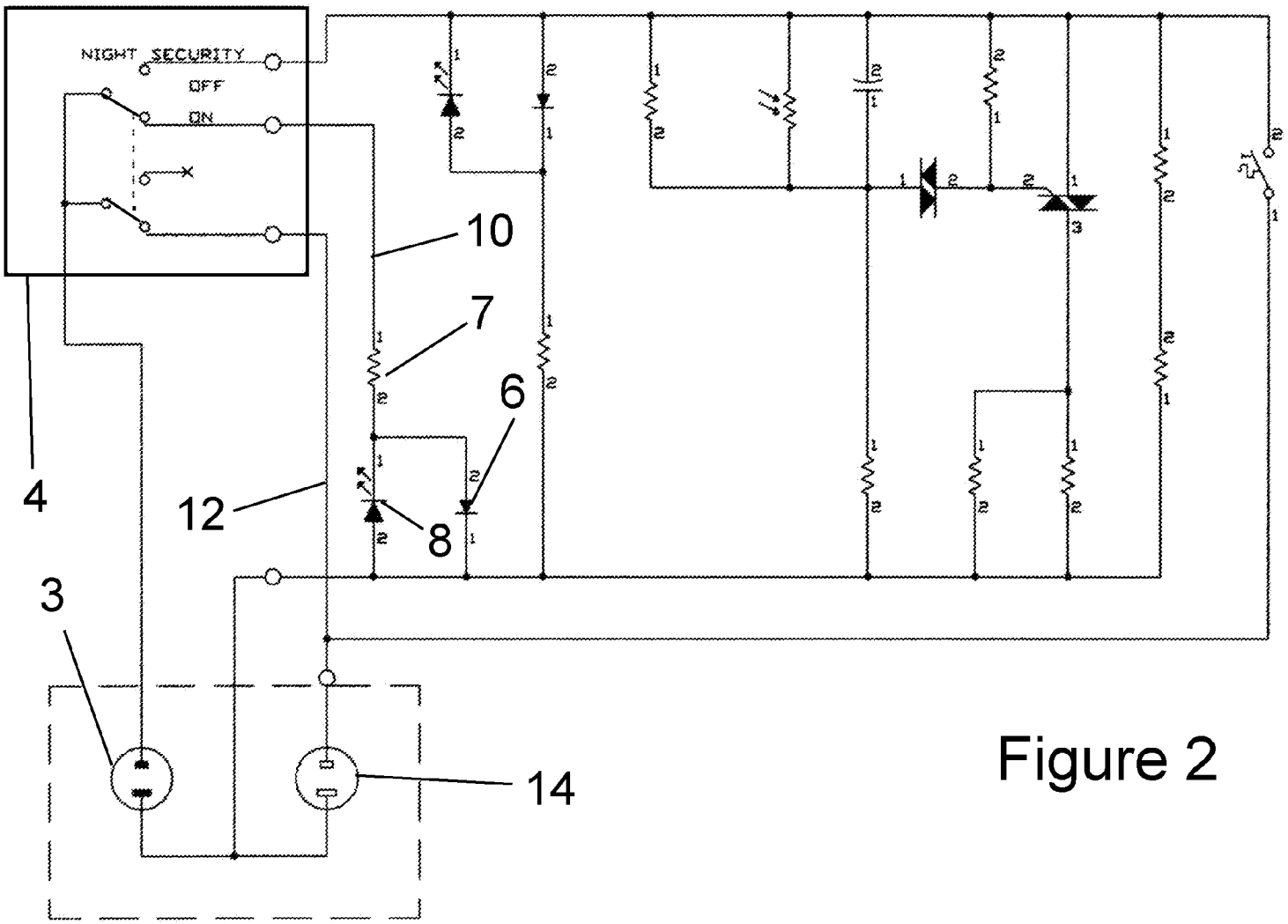
FIG. 2 is a circuit diagram of the present invention in continuous on mode.

With reference now to the drawings, and with note that as used in this specification and the appended claims, the singular forms "a," "an," and "the" include plural referents unless the content clearly dictates otherwise, a preferred embodiment of the security switch is herein explained. As seen in FIG. 1, the device, in its preferred embodiment, consists of two parallel circuits; connected to a three-position manual control switch 4, usually a Double Throw-Double Pole type, and power supply 3. When switch 4 is in the continuously "on" position, shown in FIG. 2 current flows into an indication circuit 10, denoted with visible LED 8 and diode 6, so positioned to protect LED 8 from excessive reverse voltage. Resistor 7 limits current to the LED 8. Current also flows to load 14 through a parallel bypass circuit 12. It should be noted that in the circuit drawings, FIGS. 1-3, the numerals 1 and 2 found along circuit components indicate current direction.

Figure 3:
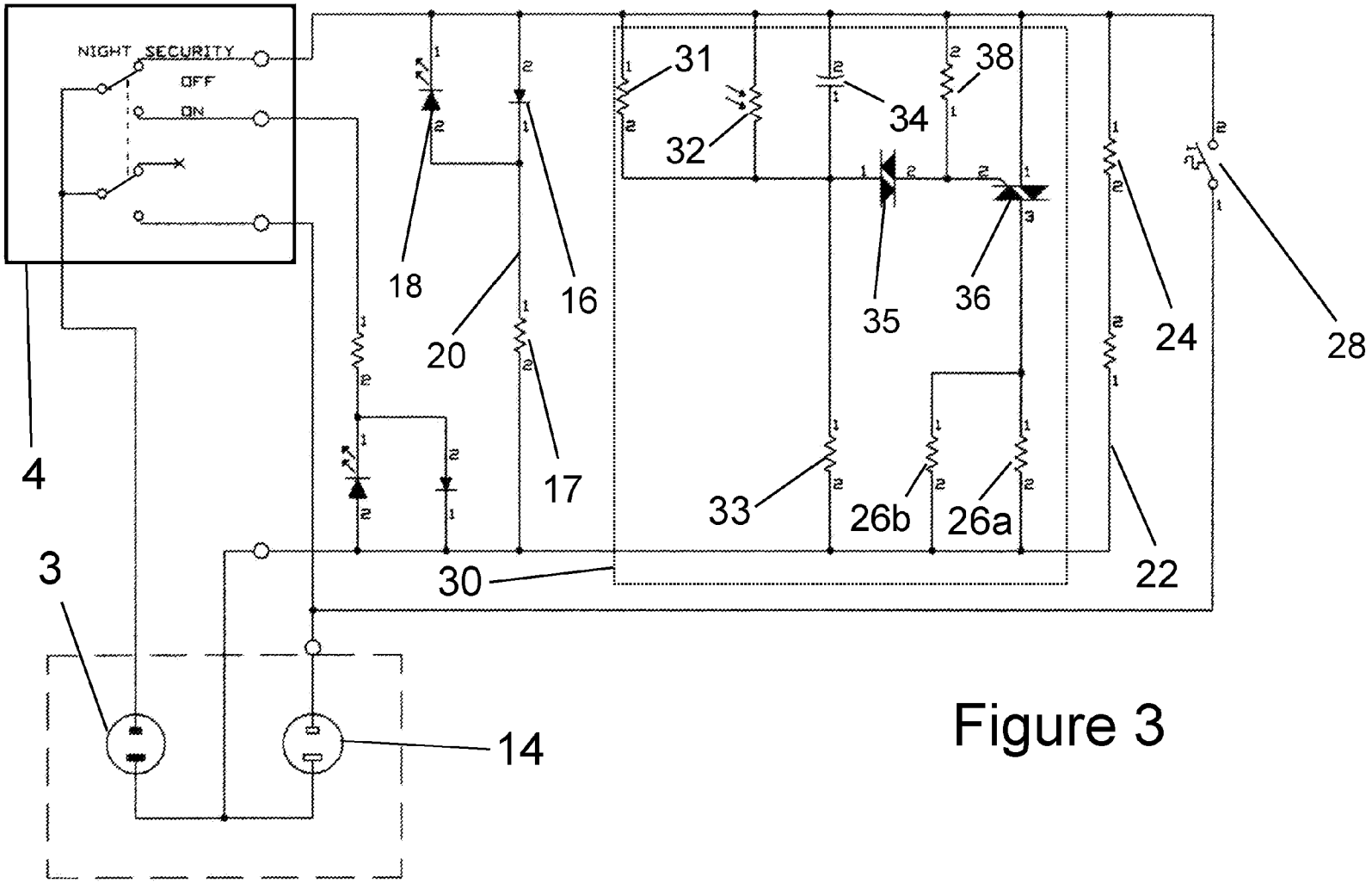
FIG. 3 is a circuit diagram of the present invention in security mode.

In FIG. 3, the switch 4 is set on security mode, activating the secondary heating circuit 22 and its associated parallel circuits. Secondary heat circuit 22 is a continuous circuit with small resistor 24 providing a constant heat source. The first parallel circuit is security indication circuit 20, with LED 18, Resistor 17, and diode 16, all serving similar function as described in indication circuit 10. Security circuit 30 contains a solid state switching circuitry and two large resistors 26*a*, 26*b*, in parallel and acting as a primary heat source. These resistors have a smaller combined resistance than resistor 24. Resistance ratios are ideally that resistor 24 should have about 4 times the combined resistance of resistors 26*a*, 26*b*.

Security circuit 30, its components demarcated within the dashed box in FIG. 3, contains a both a primary resistor 31 in series with a photocell resistor 32 which connects back into the secondary heat circuit 22. When exposed to light, the resistance in the photocell resistor 32 approaches zero and allows current to pass back into the secondary heat circuit 22. When not exposed, resistance in the photo cell 32 increases to an extreme amount, effectively cutting off the sub-circuit. Branching parallel to the photocell 32 is a secondary resistor 33, which divides the voltage along the circuit. Between the primary 31 and secondary resistors 33 is a diac 35, in parallel to the secondary resistor 33 and serving as a trigger for the gate of triac 36, in series with diac 35 and heating resistors 26*a*, 26*b*. Capacitor 34, bridging the secondary heating circuit 22 and the security circuit 30 at the location where secondary resistor 33 separates in parallel, is provided to store energy for the triggering function. The primary and secondary resistors provide different voltage across the circuit so as to operate the diac 35. Current flows to resistors 26*a*, 26*b* after the gate of the triac 36 is activated, generating heat. Ideally, the physical position of these resistors are opposite each other and proximate the thermally sensitive switch 30. A feedback resistor 38 bridges the secondary heat circuit 22 and the security circuit 30 between the diac 34 and triac 35 to prevent false triggering of triac 35, which is also connected to secondary heat circuit 22.

Figure 4:
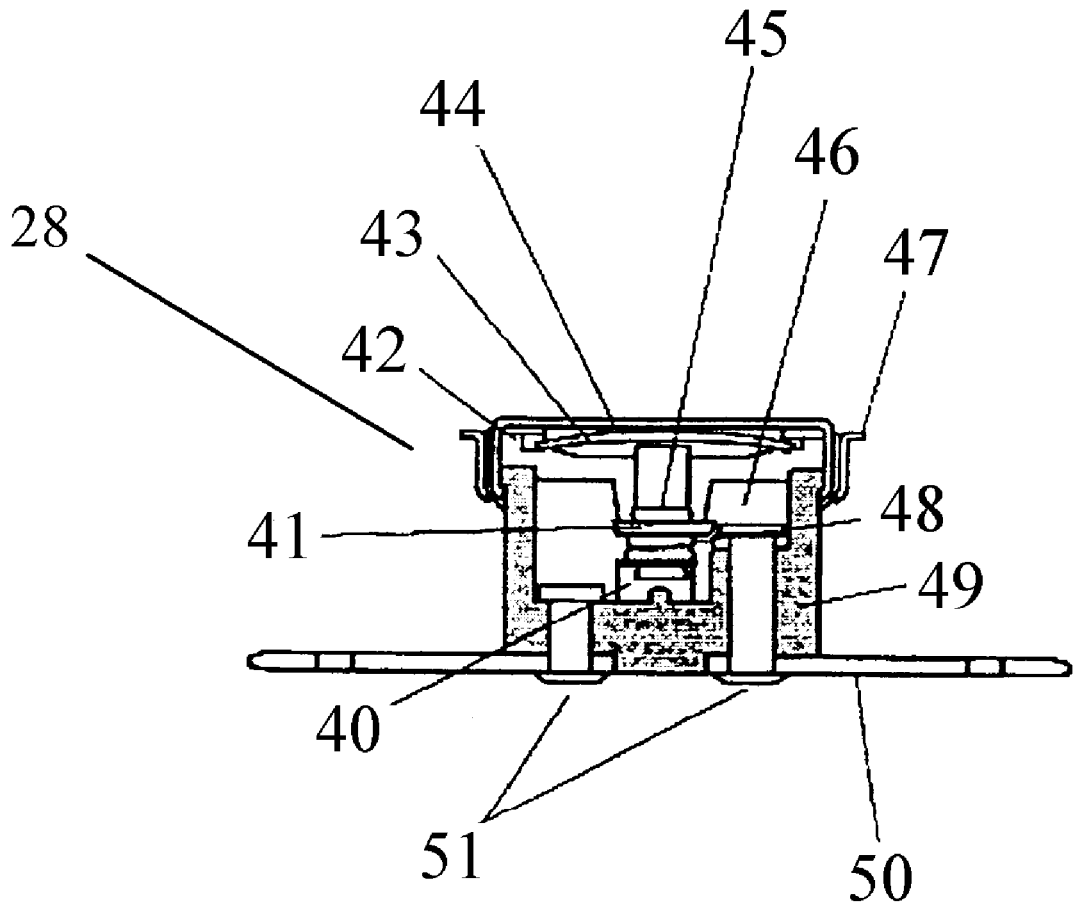
FIG. 4 is a cross sectional view of the thermally sensitive switch utilized in the invention in the open position.

When sufficiently heated, switch 28 closes. As shown in FIG. 4, the switch 28 is activated by a bimetal disc 43 opening and closing the connection between the electrical contacts 48 in the switch 28. Switch 28 comprises a movable arm 40 and a stationary arm 41, held in place by retainer 46, said movable arm 40 in operable connection to an actuating pin 45, which is moved by the contortions of bimetal disc 43. Bimetal disc 43 inherently has two metals with different expansion rates and thermal conductivity. As such, one metal will expand greatly when another does not, thus bending the disc 43 and moving the actuating pin so that movable arm 40 connects and disconnects contacts 48, opening and closing the circuit. Ideally, spacer 42 is provided to allow room for disc contortion and a sensing cap 44 closely covers the disc 43, allowing for thermal interaction, and the rest of the switch assembly in case 49. Also ideally, case 49 is riveted 51 to a terminal backing 50. It should be noted that the switch may just as easily be manufactured for either a default (room-temperature) open or closed state. In this application, the switch is described in a default open position, but the use of a default closed switch would be perfectly within the scope of this invention as it would only require an adjustment of components to have the same effect. Since the switch physically opens and closes, the waveform of electrical input is unaltered; therefore, the timer according to the present invention is safe for all types of electrical devices.

Referring to FIG. 3, input power is supplied to the output load 14 when switch 28 is closed. Ideally, the output load includes a lamp or other light generating device and such device is then turned on. The new ambient light is received by photocell 32 and its resistance plummets to near zero ohms again, thus closing the triac 35 gate and the rest of the security circuit 30. Secondary heat circuit 22 remains energized to slow provide current to resistor 24 and slow the cooling of thermally sensitive switch 28. Once sufficiently cooled, switch 28 opens, repeating the periodic on-off cycles again and again until manual switch 12 is set to "Continuous" or "Off" by the user. An enclosure isolates switch 28 and resistors 24, 26*a*, 26*b* from the exterior environment, further ensuring that the cooling process is slowed down. Likewise, an external casing, enclosing the entirety of device components, provides further thermal insulation.

Total thermal mass would include the material from which the external casing, enclosure and interior components are manufactured and any optional thermal mass added inside the enclosure and external casing to slow both the heating cycle and the cooling cycle. The optional thermal mass can be the addition of any thermally conductive material, including epoxy resin inserted into the timing module, or a thick steel disc inserted inside the enclosure on top of the thermally sensitive switch 28.

Although the present invention has been described with reference to preferred embodiments, numerous modifications and variations can be made and still the result will come within the scope of the invention. As an example, solid-state circuitry may be used to achieve the same effect as the resistors and other circuitry in this disclosure. No limitation with respect to the specific embodiments disclosed herein is intended or should be inferred.

What is claimed is:

1. A thermally sensitive electrical security device comprising:

a. a thermally sensitive switch, capable of repeatedly opening and closing, coupling a power source to an electrical load, the load and switch being coupled in series;

b. at least one heat source coupled in series with the switch and load;

c. a photoelectric cell in operable connection to both the heat source and the power source; and d. a secondary, lower temperature heater being continually connected to the power source wherein the photoelectric cell varies in resistance so as to divert current into the heat source and thereby activate the switch.

2. The security device of claim 1, further comprising a thermal isolation chamber into which the heat source and switch are enclosed.

3. The security device of claim 2, wherein the heaters are resistors.

4. The security device of claim 3, wherein the second heater is a resistor of less resistance than the resistor that is the first heater.

5. The security device of claim 4, further comprising a bypass circuit for a continual supply of power to the load.

6. The security device of claim 4 further comprising a heat sink.

7. The security device of claim 6, further comprising a bypass circuit for a continual supply of power to the load.

8. A security system for electrical loads comprising:

a. a connection means to electrical power;

b. a thermo-sensitive electrical switch, capable of physically opening and closing;

c. a connection means to an electrical load, the load and switch being connected in series;

d. a photosensitive resistor coupled to the connection means to the electrical power;

e. a primary heating resistor coupled to the photosensitive resistor in an operable relation and to the load and switch in series; and f. a secondary heating resistor in constant operable connection with the connection means to electrical power;

wherein the RMS voltage and electrical current are unaltered in an activation and deactivation cycle.

9. A non-horologically based electrical switching device comprising:

a. A connection means to a power supply;

b. A photosensitive resistor coupled to a heat source;

c. A switch capable of being both activated and deactivated by thermal conditions;

d. A connection means to an electrical load, the load, heat source, and switch being connected to each other in series; and e. a secondary low heat generation heat source that is constantly connected to electrical power wherein varying ambient light conditions affect current directed to the heat source, thereby causing random fluxations in heat generated by said heat source and correspondingly random opening and closing of the switch being somewhat independent of lighting conditions.

10. The switching device of claim 9 further comprising a heat sink, wherein opening and closing of the switch is further removed in time from changes in lighting conditions.

* * * * *